US005188242A

United States Patent [19]

Smith

[11] Patent Number: 5,188,242

[45] Date of Patent: Feb. 23, 1993

[54] SELF-ADHESIVE BIT HOLDER

[76] Inventor: David J. Smith, 5714 Seaview St., Tacoma, Wash. 98407

[21] Appl. No.: 786,545

[22] Filed: Nov. 1, 1991

[51] Int. Cl.[5] ..... A47F 7/00

[52] U.S. Cl. ..... 211/69; 206/379; 211/70.6; 248/205.3

[58] Field of Search ..... 211/70.6, 69, 69.5; 248/205.3; 206/379, 372, 373

[56] References Cited

U.S. PATENT DOCUMENTS

| | | | |
|---|---|---|---|
| 2,260,086 | 10/1941 | Matter | 211/69 |
| 3,696,920 | 10/1972 | Lahay | 248/205.3 X |
| 4,508,221 | 4/1985 | Olson | 211/70.6 X |
| 4,797,040 | 1/1989 | Hibbard | 211/69 X |
| 5,056,661 | 10/1991 | Balzano | 211/70.6 X |

*Primary Examiner*—Robert W. Gibson, Jr.

[57] ABSTRACT

A plurality of fastener bits are held in a resilient base, which is attached to a drill or other location by means of a self adhesive membrane.

3 Claims, 1 Drawing Sheet

SELF-ADHESIVE BIT HOLDER

BACKGROUND OF THE INVENTION

1. Field of the Invention

This invention relates in general to holding devices for fastener bits. More specifically this invention relates to a portable self-adhesive bit holder which is attached to the surface of a drill, tool box or other convenient place.

2. Prior Art

Since the introduction of the interchangeable fastener bit, inventors have attempted faster, more efficient ways to use and store them. Battery operated screw drivers and various driver bit containers are examples.

However, the prior art disclosed does not provide a versatile bit holder that is amenable to a necessary range of application.

A search for prior art produced no patents closely related to the present invention, although publication and catalogue searches revealed the following art.

The Bit Bandolier manufactured for Credo tool company and possibly others consists of a belt with a standard belt fastener clasp. Along the length of the belt are eleven bits attached through loops molded into the length of the belt. The Bit Bandolier fits few of the drills for which it was designed. It does not attach to other surfaces. It is costly and cumbersome in relationship to its purpose.

The Bit Dispenser tray of various styles and manufacture, usually comprises a circular storage tray with a rotating lid that allows a specifically chosen bit to fall out when rotated. It must be held with both hands to remove bits. It must also be placed back into tool box or other storage place. This embodiment also presents safety concerns for those working up on ladders. It is large, cumbersome, and expensive to manufacture.

SUMMARY OF THE INVENTION

An object of the present invention is to provide convenient and safe accessibility to fastener bits while performing work on items assembled with screwdriver fasteners.

It is also an object of the invention to provide such a device which is of simple, inexpensive construction.

Another object is to provide such a device with versatility in bit holder installation locations.

A further object is to provide such a device which will greatly reduce loss of time and expense incurred from losing and misplacing fastener bits.

These objects are attained by providing a bit holder constructed of resilient 40–50 durometer blended rubber which is stamped out of sheets using a steel rule die and press. Thus producing a holder of tapered design having a number of holes evenly spaced vertically through its interior. The holes punched are undersized allowing pressure to hold several bits of users choice.

A strip of paper covered adhesive membrane is applied to the back of holder to allow user to peel off paper, exposing adhesive membrane for placement of the invention onto a variety of surfaces.

The foregoing and other objects, features and advantages of the invention will be apparent from further discussion and illustration of the preferred embodiment.

DETAILED DESCRIPTION

Figure 1:
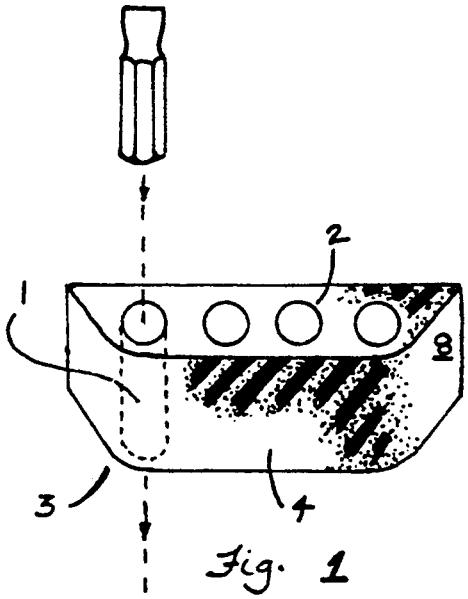
FIG. 1 is a front view, top perspective illustrating the placement of fastener bits into the holder in accordance with the present invention.

As illustrated, the preferred fastener bit holder device 8 in accordance with the present invention comprises a resilient base 4 with a plurality of holes 2 which extend vertically on the same plane through the interior 1 of the base 4 allowing the option of pushing the fastener bit down through the base 4 and removing it from the bottom of the base 4 thus preventing obstruction from other bits in the bit holder 8.

The front edges 3 are tapered and rounded to prevent snags by deflecting objects that may strike the surface of the bit holder.

Figure 2:
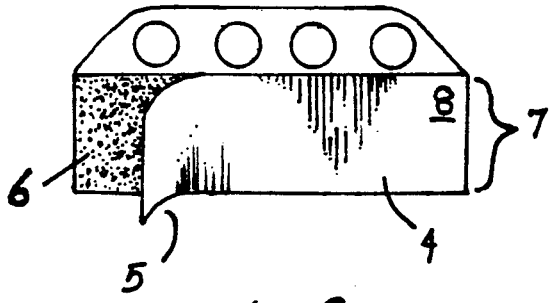
FIG. 2 is a back view, top perspective of the device of FIG. 1.

In FIG. 2 the paper 5 covering the adhesive membrane 6 which is attached to the surface of the back of the base is discarded and the bit holder 4 is ready to be attached to the preferred object.

The height 7 of the bit holder 8 is preferably $\frac{5}{8}''$–$\frac{3}{4}''$, thus allowing maximum contact with fastener bit without hindering bit removal.

In use, the bit holder is immediately and easily fastened directly to a screw gun, electric drill, tool box, drill press or any number of other locations for easy access to screw driver bits. In addition, the bit holder will adapt to work tables, automobiles, leather tool bags and related objects made of various materials.

It will be apparent that various embodiments in accordance with the present invention can be made by those skilled in the art with out departing from the spirit of the invention and it is equally apparent that the manufacture of additional or fewer holes shall not depart from the scope of the invention. It will also be obvious to those skilled in the art that various changes may be made with out departing from the scope of the invention.

I claim:

1. A tool holder for carrying fastener bits, said holder comprising:

(A) a resilient base:

(B) a plurality of holes evenly spaced and on the same plane extending vertically through said resilient base, said tool receiving holes being completely circumvented between opposed first and second surfaces, creating a retaining force on fastener bits, and (C) means for securing said holder to a tool box, drill or other supporting surface.

2. A tool holder according to claim 1 wherein said tool receiving holes are:

(A) of a smaller diameter than said fastener bits, sufficient to create constant retaining force against said fastener bits when said tool holder is applied on both either arcuate or flat supporting surfaces, and (B) said means of securing said holder comprising an adhesive membrane strip covered with a protective sheet for removal by end user.

3. A tool holder according to claim 1 wherein said means of securing said holder comprises a strip of paper covered adhesive membrane said affixed to said tool holder for adhesively securing said tool holder to a supporting surface.

* * * * *